US006622319B2

(12) United States Patent
Mousseau et al.

(10) Patent No.: US 6,622,319 B2
(45) Date of Patent: Sep. 23, 2003

(54) PORTABLE TOILET ACCESSORY

(76) Inventors: Rosalind Doris Mousseau, P.O. Box 1485, Timmins, Ontario (CA), P4N 7W7; Darryl Joseph Mousseau, P.O. Box 1485, Timmins, Ontario (CA), P4N 7W7

( * ) Notice: Subject to any disclaimer, the term of this patent is extended or adjusted under 35 U.S.C. 154(b) by 0 days.

(21) Appl. No.: 09/781,447

(22) Filed: Feb. 13, 2001

(65) Prior Publication Data

US 2002/0108173 A1 Aug. 15, 2002

(51) Int. Cl.[7] ..... A47K 11/04; E03C 1/18
(52) U.S. Cl. ..... 4/661; 4/476
(58) Field of Search ..... 4/476–478, 661; 52/309.4, 309.6, 309.7, 309.11

(56) References Cited

U.S. PATENT DOCUMENTS

| | | | | | |
|---|---|---|---|---|---|
| 2,376,653 | A | * | 5/1945 | Boyer | 52/309.11 |
| 3,503,167 | A | * | 3/1970 | Mackie | 52/309.6 |
| 3,688,458 | A | * | 9/1972 | Inmon et al. | 52/309.11 |
| 5,418,982 | A | * | 5/1995 | Kishi | 4/111.1 |
| 5,500,960 | A | * | 3/1996 | Tagg | 4/318 |
| 5,671,487 | A | * | 9/1997 | Chen | 4/449 |
| 5,974,597 | A | * | 11/1999 | Conwell | 4/431 |

* cited by examiner

*Primary Examiner*—Tuan N. Nguyen
(74) *Attorney, Agent, or Firm*—James Creighton Wray; Meera P. Narasimhan

(57) ABSTRACT

An insulating cover for a portable toilet as used on construction sites and for outdoor events is described. In one arrangement insulating panels are fastened around the portable toilet to reduce the escape of heat therefrom.

11 Claims, 1 Drawing Sheet

PORTABLE TOILET ACCESSORY

FIELD OF THE INVENTION

This invention relates to portable toilet accessories.

Portable toilets are used extensively on construction sites and for special events such as parties, etc.

One problem with portable toilets is that they can become very cold to use during the winter and the contents of the holding tank freezes in the cold weather. A heater can be supplied with the portable toilet but, due to the usual construction of the toilet, the heat readily escapes therefrom. The portable toilet is usually manufactured with a front wall, including a door, a rear wall, two opposite side walls, a top and a floor for standing on.

SUMMARY OF THE INVENTION

According to the present invention there is provided an insulating cover for a portable toilet.

In one arrangement the cover comprises a front panel of insulating material cut to the size and shape of the front wall of the portable toilet; a rear panel of insulating material cut to the size and shape of the rear wall of the portable toilet; a plurality of side panels of insulating material each cut to the size and shape of a respective side of the portable toilet; and a roof panel of insulating material cut to the size and shape of a top of the portable toilet.

BRIEF DESCRIPTION OF THE DRAWINGS

Embodiments of the invention will now be described, by way of example, with reference to the accompanying drawings in which.

DETAILED DESCRIPTION

Figure 1:
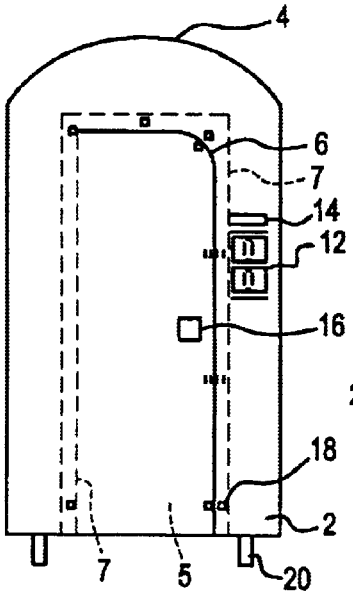
FIG. 1 is a front view of a front insulating panel according to one embodiment of the invention.

Referring to FIG. 1, the front panel 2 is of approximately rectangular shape when viewed from the front with a rounded top 4. A door opening 6 is cut in the front panel 2.

Figure 6:
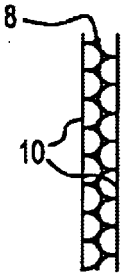
FIG. 6 is a cross-sectional view of part of a panel to show the construction thereof.

All the panels in FIGS. 1 to 4 are constructed of bonded polyester insulation material 8 (FIG. 6).

All the panels in FIGS. 1 to 4 are constructed of bonded polyester insulation material 8 (FIG. 6) covered with polyethylene material 10 attached to both surfaces with adhesive. The polyethylene material 10 consists of high-density polyethylene tapes coated with low-density polyethylene on both sides of the tapes. This material contains U.V. inhibitors and is well suited for outdoor applications.

The door opening 6 (FIG. 1) is cut and trimmed with pieces of the polyethylene 10. A gender cardholder 12, as well as a nameplate 14, is sewn to the front panel 2.

Figure 7:
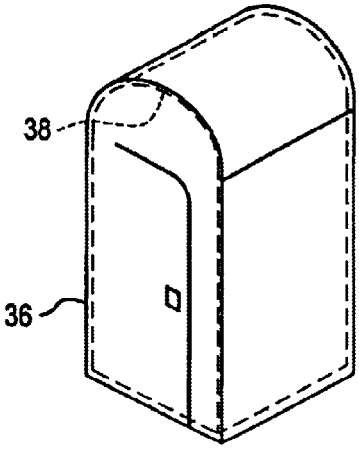
FIG. 7 is a perspective view of a second embodiment of the invention.

A door handle hole 16, or door pull hole, is cut and sewn in place as shown in FIG. 1. The lower edge of the panel 2 is trimmed and two tie loops 20 are installed. Snap fasteners 18 are installed to attach portions of the front panel 2 to the door 5 and frame 7 of the portable toilet 38 (FIG. 7).

Figure 3:
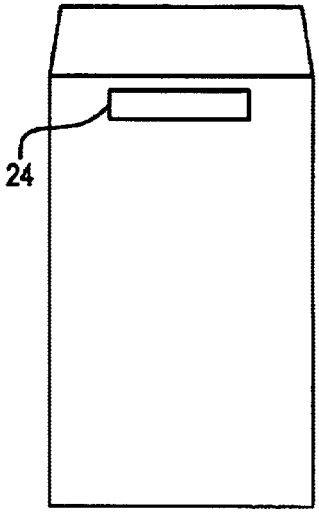
FIG. 3 is a view of a side insulating panel.
Figure 4:
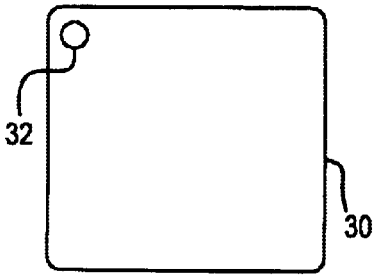
FIG. 4 is a view of a roof panel.

The two side panels 22, as shown in FIG. 3, are cut and sandwiched with glue and insulation (sandwich combination FIG. 6) as was the front panel 2. A window frame is cut and sewn whilst a clear, 30 mil. U.V. resistant PVC window 24 is sewn in place. If the particular model of portable toilet to be covered does not have windows or vents this step is omitted. The lower edge of panel 22 is trimmed.

Figure 2:
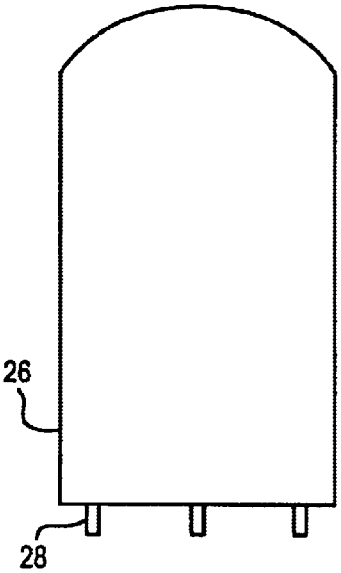
FIG. 2 is a view of a rear insulating panel.

The rear panel 26 of FIG. 2 is cut from the insulated combination (FIG. 6) and constructed as described above. The lower edge of the panel 26 is trimmed and three tie loops 28 (see FIG. 5) are installed at the rear.

The roof panel 30 (FIG. 4) is cut and Constructed with the insulated combination (FIG. 6) as described above. A vent hole 32 is located in position and a circular pattern sewn but not cut out. The customer will cut this out for ventilation if required.

During assembly of the portable toilet cover, the roof panel 30 and side panels 22 are attached by sewing them together. The front panel 2 and rear panel 26 are then sewn to the side panels 22 and the roof panel 30.

Figure 5:
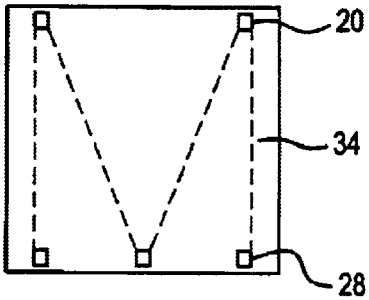
FIG. 5 is a view of the open bottom of the portable toilet cover.

A rope attachment 34 is threaded through the loops 20 and 28 as shown in FIG. 5 to attach the cover to the portable toilet.

In FIG. 7 a second embodiment of the invention is illustrated. This comprises an insulating quilted cover 36 for fitting around and over the portable toilet 38 with appropriate openings and flaps. A quilted, or other cover, could also be used in combination with the panels of FIGS. 1 to 4.

It will be appreciated that the fastening of the door 6 (FIG. 1) can be by any mechanical means, such as the snaps 18 in FIG. 1, VELCRO* (hook and loop), ¼ turn buttons, lift the dot fasteners, snap lock buttons (TENAX*) etc. All these are two (2), three (3), or four (4) part holding mechanisms. They can be glued, riveted or screwed to the door frame and the door.

* Trademark

In addition to the insulated cover, high-density Styrofoam* may be placed below the portable toilet floor. This material, typically two inches thick, is cut to size depending on the model of the portable toilet.

The rope 34 (FIG. 5) on the bottom of the portable toilet cover has two uses. First, for securing the insulated cover itself to the portable toilet. The second use for the rope 34 is to secure the high-density Styrofoam* insulation as described above.

From the above it will be seen that the described embodiments enable a portable toilet to maintain warmth even during winter months. The structure of the existing toilet, in use, forms the contour of the cover. It is placed over the toilet hut and is snapped to the existing door and frame. Tie loops located on the lower edge of the front and rear panels are fastened to each other under the portable toilet, securing the cover in place. The insulated covers provide a way for contractors to meet existing regulations, such as in Canada, Section 29.1(1) of the Ontario Occupational Health and Safety Act and regulations, requiring the units to be adequately heated.

It will be readily apparent to a person skilled in the art that a number of variations and modifications can be made without departing from the true spirit of the invention which will now be pointed out in the appended claims.

*Trademark

We claim:

1. A heat insulating cover for overlying existing front, rear and side walls and top of a portable toilet comprising:

(a) a front panel of heat insulating material cut to the size and shape of the existing front wall of the portable toilet;

(b) a rear panel of heat insulating material cut to the size and shape of the existing rear wall of the portable toilet;

(c) a plurality of side panels of heat insulating material each cut to the size and shape of the existing respective side walls of the portable toilet; and (d) a roof panel of insulating material cut to the size and shape of the existing top of the portable toilet, (e) fasteners connected to the panels for attaching the heat insulating cover over the existing walls of the portable toilet.

2. A cover according to claim 1, wherein a door opening is cut in the front panel and is provided with fastening means for affixing to a door in the existing front wall of the portable toilet.

3. A cover according to claim 1, wherein a door opening is cut in said front panel and is provided with fastening means for affixing to a door and a frame in the existing front wall of the portable toilet.

4. A cover according to claim 1 wherein each panel is constructed of polyester insulating material covered on both sides with polyethylene material cut to size and attached with adhesive, said polyethylene material containing U.V. inhibitors.

5. A cover according to claim 1, wherein loops are provided on a bottom of at least the front panel and the rear panel and, in use, a rope is threaded through the loops.

6. A cover according to claim 5, wherein a heat insulating base panel is secured to an existing floor of the portable toilet by the rope.

7. A cover for a portable toilet according to claim 1, wherein the cover is a heat insulating quilted cover for fitting around and over the top and existing walls of the portable toile with appropriate openings and flaps.

8. A heat insulating cover for the portable toilet according to claim 1, wherein the roof panel is attached to the front, rear and side panels.

9. A heat insulating cover for the portable toilet according to claim 1, wherein the front, rear and side panels have lower edge portions, with mechanical means for securing the lower edge portions to the portable toilet, wherein the insulated cover removably fits around and over the portable toilet.

10. A heat insulating cover for a portable toilet according to claim 3, wherein the heat insulating cover removably fits around and over existing front, rear and side walls and top of the portable toilet.

11. A heat insulating cover for a portable toilet according to claim 3, panels of insulating material are cut to fit together so as to enclose existing front, rear and side walls and top of the portable toilet to reduce the escape of heat therefrom.

* * * * *